US005757602A

United States Patent [19]

Meili et al.

[11] Patent Number: 5,757,602

[45] Date of Patent: May 26, 1998

[54] OVERCURRENT PROTECTIVE SWITCH, SPECIFICALLY A MOTOR PROTECTIVE SWITCH

[75] Inventors: Hans-Peter Meili, Seon; Karin Hannelore Spengler-Schmid; Stephan Spengler, both of Siblingen, all of Switzerland

[73] Assignee: Allen-Bradley Company, Inc., Milwaukee, Wis.

[21] Appl. No.: 790,496

[22] Filed: Jan. 29, 1997

[30] Foreign Application Priority Data

Feb. 6, 1996 [CH] Switzerland ..... 00307/96

[51] Int. Cl.[6] ..... H01H 73/00

[52] U.S. Cl. ..... 361/115; 361/632

[58] Field of Search ..... 361/93, 102, 115, 361/31, 605, 632, 615; 307/112, 125, 131, 139, 142; 335/6–7, 18, 21

[56] References Cited

U.S. PATENT DOCUMENTS 5,172,294 12/1992 Ineichen et al. ..... 361/115

*Primary Examiner*—Jeffrey A. Gaffin
*Assistant Examiner*—Michael J. Sherry
*Attorney, Agent, or Firm*—John M. Miller; John J. Horn

[57] ABSTRACT

The overcurrent protective switch contains a switch lock 8, which, in the switched on position, holds the movable contact pieces 3 in engagement with the fixed contact pieces 2 against the force exerted by at least one switch-off spring. The switch lock 8 comprises a switch splicing plate 10 connected to the movable contact pieces 3 in an articulated mechanism; a toggle lever splicing plate 12 connected to the switch splicing plate 10 at a toggle joint 13; and a pawl lever 15 mounted in a position inside the housing 1, which is supported by a trigger pawl 17 and connected with the toggle lever splicing plate 12 in an articulate mechanism. The joint axles 11, 13, 16 of the switch splicing plate 10 and the toggle lever splicing plate 12, as well as the pivot bearing axle 14 of the pawl lever 15 are in the on state arranged on a slightly curved line, so that a past dead center condition is created. Under this condition, the toggle joint 13 is supported against a latched stop slide 22, the latching of which is released when switched off manually. The pawl lever 15 is capable of swiveling in both directions, that is, in one direction when the trigger pawl 17 is actuated, and in the other direction when switched off manually. Thus, a quick switching off is achieved either manually or by a current surge, using only a few simple components.

4 Claims, 6 Drawing Sheets

OVERCURRENT PROTECTIVE SWITCH, SPECIFICALLY A MOTOR PROTECTIVE SWITCH

FIELD OF THE INVENTION

This invention relates to an overcurrent protective switch, specifically a motor protective switch with fixed contact pieces installed in a housing, which, depending on phase, are bypassed by movable contact pieces while the overcurrent protective switch is in the on-position. The movable contact pieces, which are acted upon by at least one switch-off spring, are equipped with a switch lock. The switch lock is set in motion either by a hand-operated device or by overcurrent triggering elements, and acts upon the movable contact pieces, which slide inside the housing, by way of a toggle lever pair consisting of a toggle lever splicing plate and a switch splicing plate. Thereby, the end region of the toggle lever splicing plate, which faces away from the toggle joint of the toggle lever pair, is bearing-mounted on a pawl lever so that it can swivel. The pawl lever, which in turn is mounted in bearing so as to swivel inside the housing, is supported in the switched-on position by a trigger pawl acted upon by overcurrent triggering elements. The hand-operated device is in active connection with the toggle joint of the toggle lever pair.

BACKGROUND OF THE INVENTION

An overcurrent protective switch of the type mentioned earlier is known from DE-C1-4304769. In this overcurrent protective switch, the movable contact pieces are held in place in the on position, against the force exerted by the switch-off spring through a toggle lever pair, consisting of a toggle lever splicing plate and a switch splicing plate. The switch splicing plate is located closer to the movable contact pieces. The end of the toggle lever splicing plate, facing away from the switch splicing plate is mounted in bearing at one end of a V-shaped pawl lever, and the other end of this V-shaped pawl lever is mounted in bearing inside the housing of the overcurrent protective switch so that it swivels. The top of the V-shaped pawl lever is supported in the on position of the overcurrent protective switch by a pawl, which is released by overcurrent triggering agents. In the case of a current surge, the pawl swivels away from the pawl lever. As a result, the pawl lever pair collapses and the switch-off spring separates the movable contact pieces from the fixed contact pieces. This separating process takes place with a relatively high switch-off speed. In order for this quick switch-off to also occur in the case of a manual actuation independent of the switch-off motion of the hand drive the overcurrent protective switch is equipped with an additional switch-off lever. The switch-off lever is joined to the pawl by a bearing and stands in the housing by the means of spring pull. In the case of manual switching off, a driver takes with it the switch-off lever in the direction of its length and thus, brings the pawl over its mounting. Thereafter, the pawl lever is no longer supported by the pawl. As soon as the support of the pawl lever is canceled, the pawl lever pair collapses, resulting in a quick switch off. The disadvantage of this overcurrent protective switch is that it requires too many parts for its operation, rendering it not only too complicated, but, because of the high costs involved in its assembly, economically unfavorable.

From DE-PS-2123765, a further overcurrent protective switch is disclosed, consisting of fixed contact pieces which, in the on condition and at each phase, are bypassed by movable contact pieces. The movable contact pieces are joined with a switch splicing plate, which, along with a pawl lever, forms a toggle lever pair. In the switched-on state, the toggle lever pair is stretched over the center position. When switching off, however, the pair bends in and, thus, enables a quick separation of the movable contact pieces from the fixed contact pieces. In the on position, the pawl lever is propped against a pawl, which is activated through overcurrent triggering agents. In both the case of a current surge as well as in the case of a manual triggering, the pawl lever pair bends in, resulting in a relatively quick separation of the movable contact pieces from the fixed contact pieces through a switch-off spring. This switch lock is complicated and, therefore, expensive. An additional disadvantage of this arrangement arises from the fact that it is not possible to visually determine from the hand-operated device, whether the switching off occurred as a result of a current surge, or whether it was triggered manually. The hand-operated device of this overcurrent protective switch has only an ON and an OFF position.

SUMMARY OF THE INVENTION

The task of the present invention is to simplify and improve the aforementioned overcurrent protective switch, using the same individual parts in an economic manner, so that a quick switching off can be achieved independent of the operating speed of the hand-operated device, both in the case of a current surge, as well as in the case of a manually triggered switching off, while two different positions of the hand-operated device make it possible to visually determine whether the switching off was triggered manually, or as a result of current surge.

This problem is solved as follows: The joint axles of the switch splicing plate and the toggle lever splicing plate, as well as the axle of the pivot bearing of the pawl lever are arranged in such a manner that, when the overcurrent protective switch is on, all three axles are positioned on a slightly curved line, one behind the other, facing one direction. Thus at a position past the center and in an extended position, the switch splicing plate, the toggle lever splicing plate, and the pawl lever are stretched through the force exerted by the switch-off spring. Thereby, the pawl lever is propped against the trigger pawl, and the toggle joint, located between the switch splicing plate and the toggle lever splicing plate, is propped against a latched stop slide in which the latch is releasable. Furthermore, the pawl lever is designed so that, from the position it assumes when the overcurrent protective switch is on, it can swivel about the pivot bearing axle in both directions, that is in the one direction after the trigger pawl is actuated, and in the other direction after the latch of the stop slide is released, by setting the position of the hand-operated device from the on to the off position. Moreover, through the toggle joint of the pawl lever pair, the hand-operated device is in active connection with at least one driving surface, which becomes effective once the hand-operated device is switched on. The toggle joint is spring-loaded in a direction facing away from the stop slide. Because of the fact that the switch splicing plate, the toggle lever splicing plate, and the pawl lever are aligned, in the on position of the overcurrent protective switch, over a past dead center line, and because the pawl lever is propped against the stop slide, a quick switching off can be achieved through the bending in of the toggle lever pair, as a result of overcurrent, thus, setting the stop slide in motion. Through the release of the stop slide latch, the toggle joint of the toggle lever pair can be bent out of the switched on position, whereby the location of the toggle lever splicing plate joint at the pawl lever is moved and, thus, comes out of the center position. As soon as this occurs, the pawl lever swivels away from the stop slide and initiates a quick, abrupt turning off of the overcurrent protective switch. Due to the bi-directionally effective pawl lever, a quick interruption of the contact points can be achieved, both through a current surge as well as by manual switching, using the same components. After having been activated by overcurrent, the hand-operated device assumes a distinct position, different from that it would have assumed after a manual switching off. This occurs because, in the case of an overcurrent switch off, the pawl lever does not allow the toggle joint, or the handoperated device actively connected to the toggle joint, to be bent in as far as it can in the case of a manual switch off.

The pawl lever is constructed with two arms and a torsion spring, which holds the pawl lever spaced from the trigger pawl, while the pawl lever is at its neutral position corresponding to the off-position of the overcurrent protective switch. Because of the two-armed design of the pawl lever, it is easy for the pawl lever to be supported by the trigger pawl, when the overcurrent protective switch is in the on-position. The spring torsion ensures that in the off-position of the overcurrent protective switch, the pawl lever, which is in a released condition, maintains its ready position.

The trigger pawl can be equipped with a torsion spring which holds it in a neutral position while at the same time, the pawl lever is blocked. Thus, in its released position, the trigger pawl is maintained through this torsion spring in the ready position.

The hand-operated device can be connected to a two-pronged pivoting switch fork exhibiting two opposing surfaces, whereby, in the case of a blocked stop slide occurring when switching off manually, one of the inner surfaces of the switch fork takes the toggle joint out of the center position, and thus, by the bending in action of the toggle lever pair, the pair is brought into the off position. Meanwhile, the other inner surface, which, at a switching on motion of the hand-operated device forms the driving surface acting upon the toggle joint, presses the toggle joint into the center position when switching on. This arrangement makes the switching off of the overcurrent protective switch possible even when the toggle joint supporting the stop slide is for any reason blocked in the switch on position.

In the following, an embodiment of the invention is described in detail by means of the attached drawings.

Figure 5:
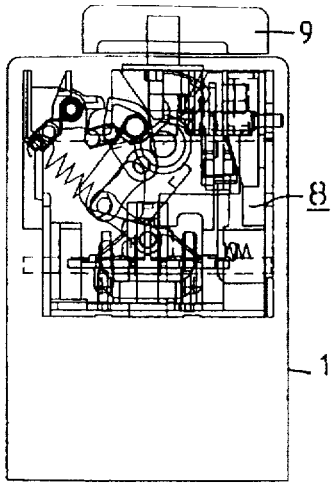
Figure 8:
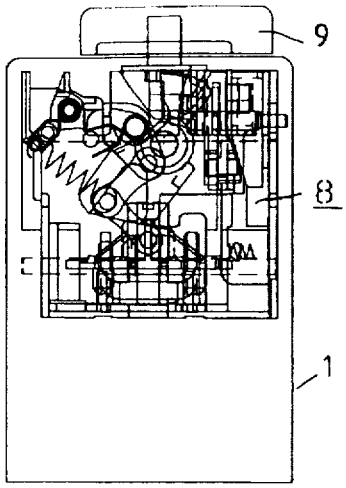
Figure 6:
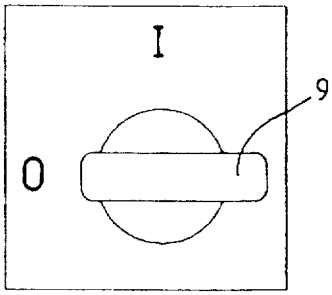
Figure 9:
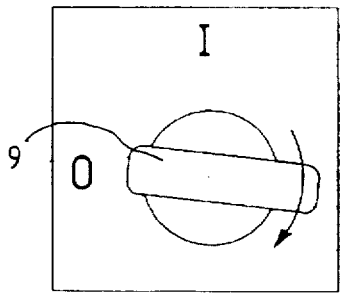
Figure 7:
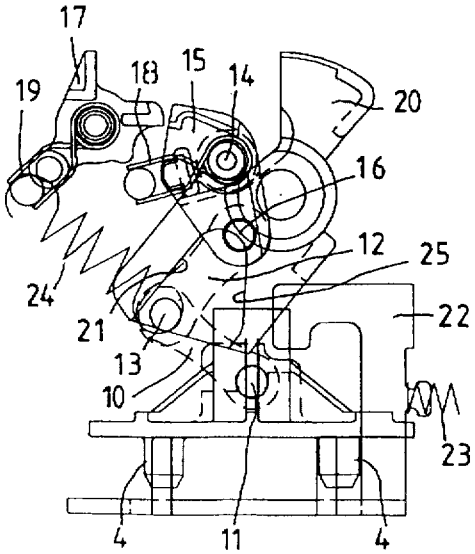
Figure 10:
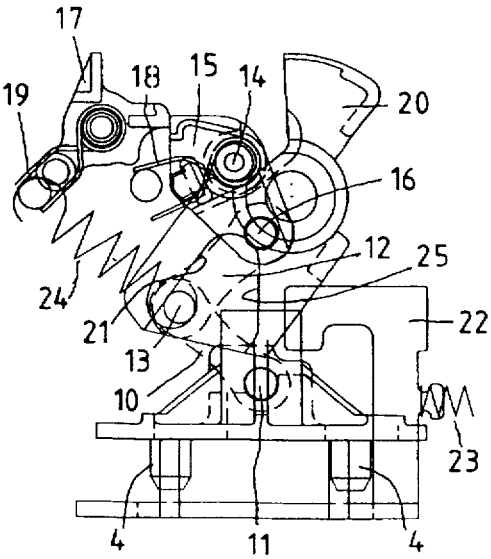

FIGS. 5, 6, and 7 illustrate the arrangement of the switch lock, the position of the control knob, and a schematic of the switch lock in the off-position, respectively.

FIGS. 8–13 illustrate the arrangement of the switch lock, the position of the control knob, and a schematic of the switch lock in two intermediate positions during a switching on motion, respectively.

Figure 14:
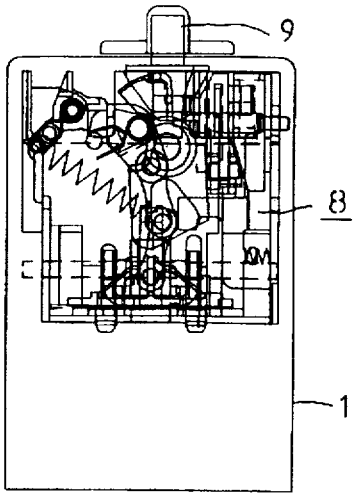
Figure 15:
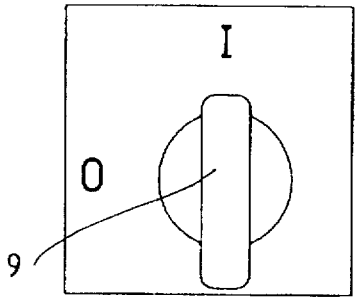
Figure 16:
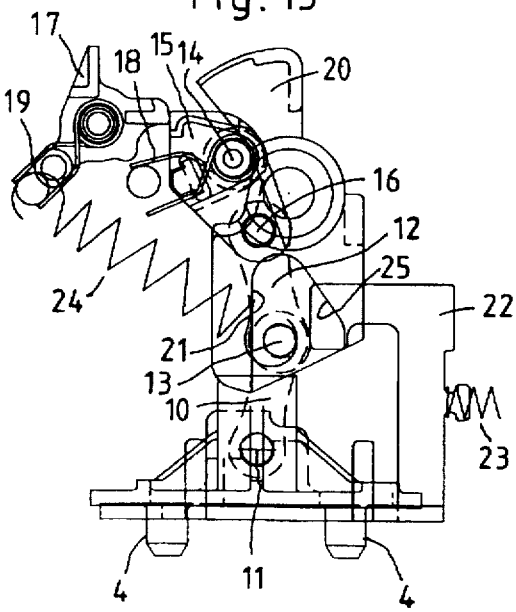
Figure 17:
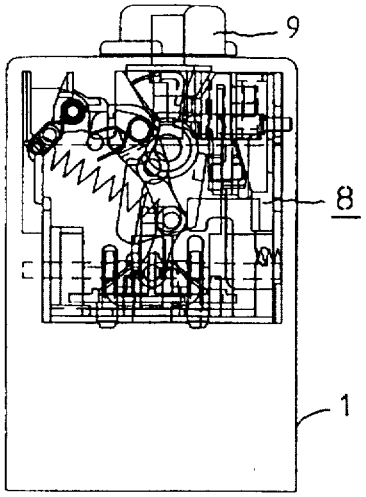
Figure 20:
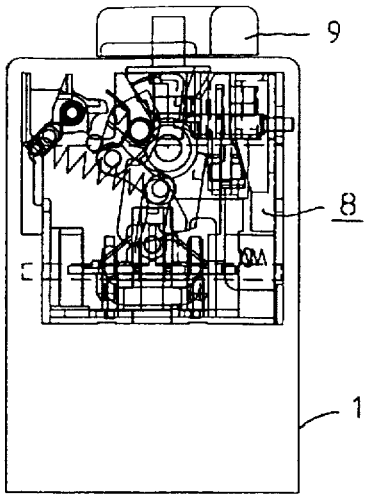
Figure 18:
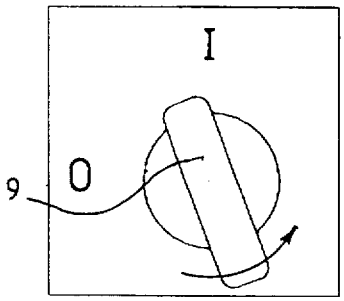
Figure 21:
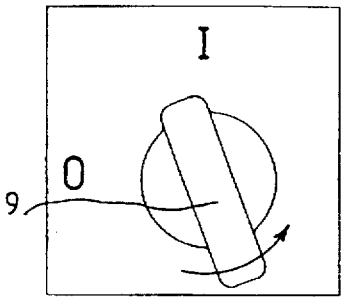
Figure 19:
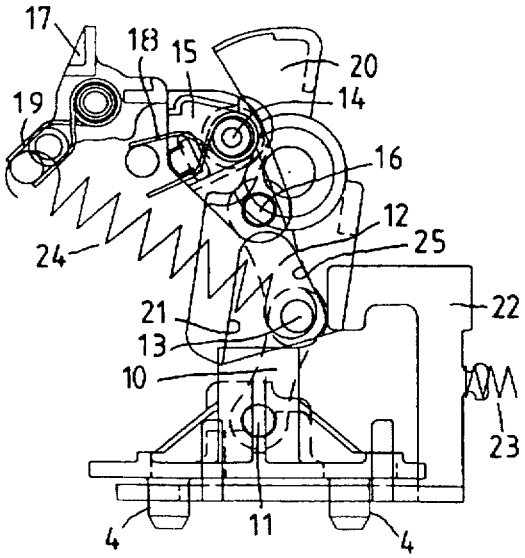

FIGS. 14, 15, and 16 illustrate the arrangement of the switch lock, the position of the control knob, and a schematic presentation of the switch lock in the on-position, respectively.

FIGS. 17–28 illustrate the arrangement of the switch lock, the position of the control knob, and a schematic of the switch lock in four different intermediate positions during a switching off motion, respectively.

Figure 29:
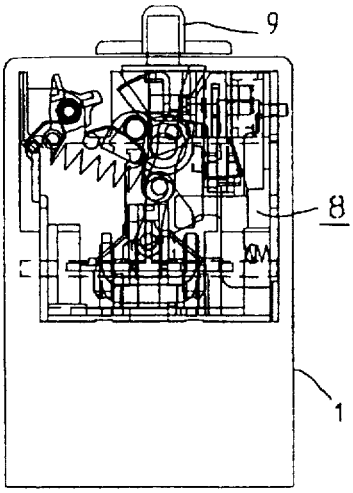
Figure 30:
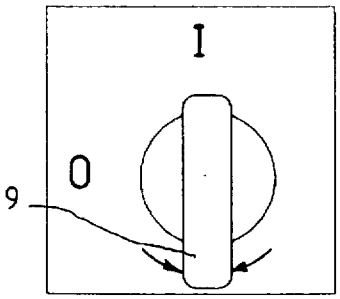
Figure 31:
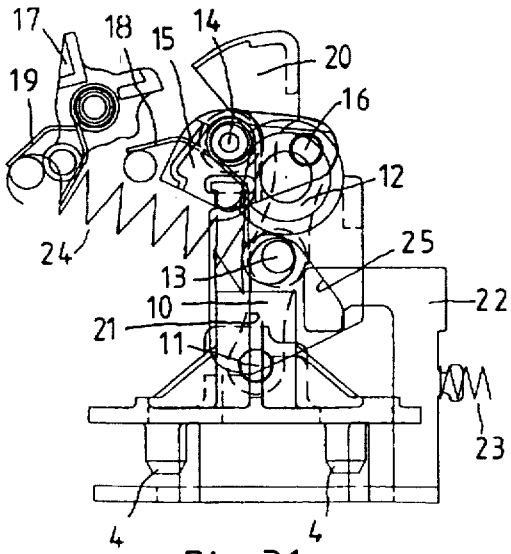

FIGS. 29, 30, and 31 illustrate the arrangement of the switch lock, the position of the control knob, and a schematic of the switch lock in the position set by the overcurrent triggering elements, while the control knob is held at a fixed position.

Figure 32:
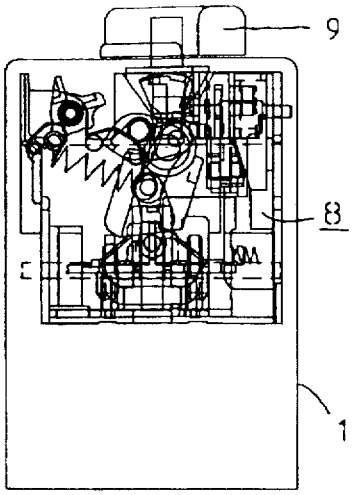
Figure 33:
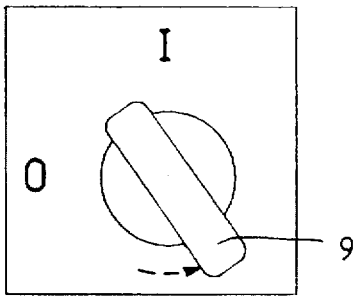
Figure 34:
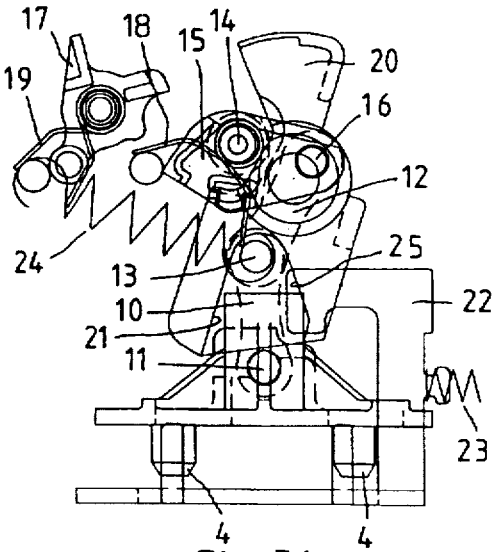

FIGS. 32, 33, and 34 illustrate the arrangement of the switch lock, the position of the control knob, and a schematic of the switch lock in the position set by the overcurrent triggering elements, while the control knob is held at a position that allows it to move freely.

DETAILED DESCRIPTION OF THE PREFERRED EMBODIMENT

Figure 2:
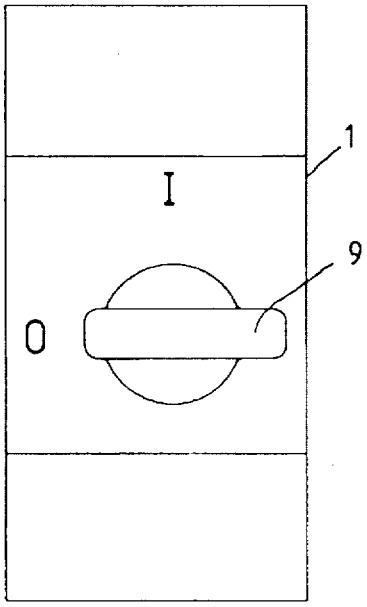
FIG. 2 illustrates the position taken by the control knob in the off position.
Figure 1:
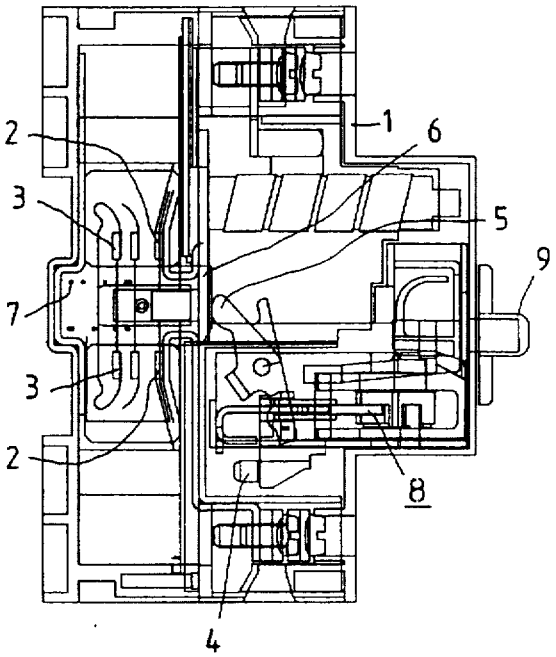
FIG. 1 illustrates the side view of the essential parts of the overcurrent protective switch in the off-position with the housing walls removed.

In FIG. 1, a side view of an overcurrent protective switch is presented with the housing walls removed. For the purpose of clarity, this figure shows only the essential parts necessary for the description of the overcurrent protective switch. Fixed contact pieces 2 are fastened inside the housing 1. Furthermore, the movable contact pieces 3, which bypass said fixed contact pieces 2 at each phase in the on-position of the overcurrent protective switch, are separated from said fixed contact pieces 2, and the switch is in the off-position. The movable contact pieces 3 are brought into the switch-off position and held there in place, by at least one switch-off spring not shown acting upon studs 4 located at one end region of a switch lever 5 mounted in the housing so that it is free to swivel. The other end of the switch lever 5 presses the contact carrier of the movable contact pieces 3 against the force exerted by a switching-on spring 7. A switch lock 8 acts upon the end region of the switch lever 5 where the studs 4 are located. The function of the switch lock 8 will be explained with reference to FIGS. 5–34. The switch lock is activated either manually by a hand-operated device containing a control knob 9, or through thermal and/or dynamic parts contained in the overcurrent triggering agents. The control knob 9 and its position are clearly seen in the top view of the switched off overcurrent protective switch in FIG. 2.

Figure 4:
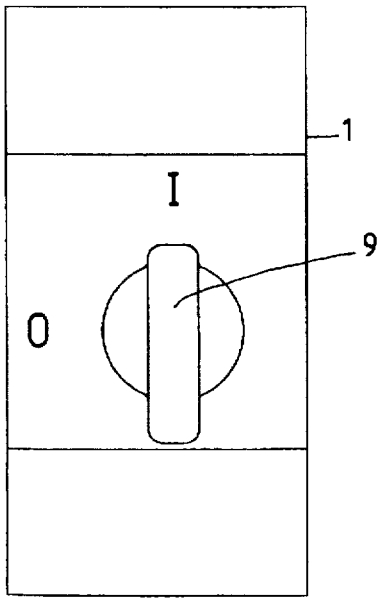
FIG. 4 illustrates a position of the control knob.
Figure 3:
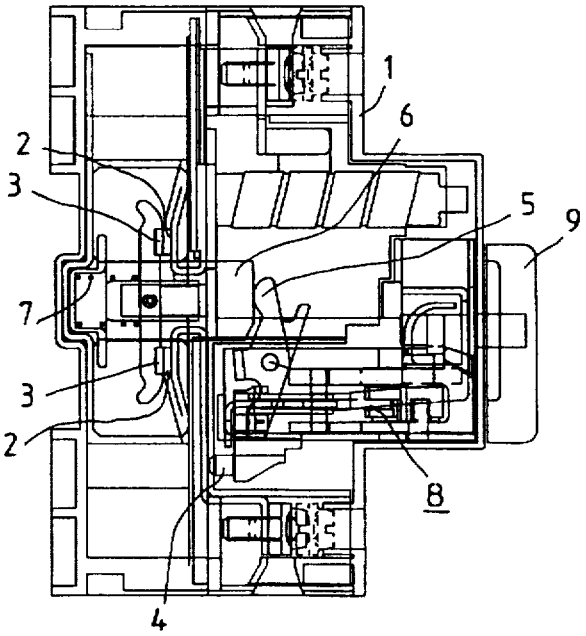
FIG. 3 illustrates a side view of the essential parts of the overcurrent protective switch in the on-position with the housing walls removed.

FIG. 3 shows the same overcurrent protective switch in the on condition. The end region of the control lever 5, carrying the studs 4, is held pressed by the pressure of a switch-off spring not shown. The other end of the control lever 5 allows the contact carrier ó of the movable contact pieces 3 to glide into the switch-on position with the help of the switch-on spring. In FIG. 4, the position of the control knob 9 is depicted for the on condition of the overcurrent protective switch.

FIGS. 5, 6, and 7 show parts of the overcurrent protective switch in the off position. In FIG. 5, the housing 1, the control knob 9, and the switch lock 8 are indicated schematically. FIG. 6 shows the position of the control knob in the off condition. FIG. 7 is a schematic presentation of the most important parts of the switch lock 8. In this switching position, the switch lock 8 is released. At the studs 4 carrying end region of the switch lever, a switch splicing plate 10 is coupled with the joint axle 11. The switch splicing plate 10 is also connected with a toggle lever splicing plate 12 in an articulated junction, where both splicing plates, along with the toggle joint 13 located between the two, form a toggle lever pair. The end region of the toggle lever splicing plate 12, facing away from the toggle joint 13, is seated with the joint axle 16 over a pawl lever 15, which swivel inside the housing 1 in both directions about the axle of the pivot bearing 14. A trigger pawl 17, mounted inside the housing 1 so as to be able to swivel, is connected with the overcurrent triggering agents. In the neutral state, the trigger pawl limits the counterclockwise swivel motion of the pawl lever 15. In this neutral state, the two-armed pawl lever 15 is held in position and somewhat spaced apart from the trigger pawl 17 by a torsion spring 18. Due to the torsion spring 19, the trigger pawl 17 remains at the neutral state in a position that blocks the pawl lever 15 in the counterclockwise direction. Through a bevel gear not further depicted, the control knob 9 is connected in a form-fitted connection to a two-armed hand-operated lever 20 mounted inside the housing 1. On one of its arms, the hand-operated lever 20 exhibits a driving surface 21. At the dead center position with the overcurrent protective switch turned on FIG. 16, a stop slide 22 having a releasable latch supports the toggle joint 13. The spring 23 loaded stop slide 22, in a released latch state, is connected with the toggle joint 13 in a small region in a butt-joint. In the switched on position, the stop slide is latched through the hand-operated device in a manner not further depicted. At the beginning of a switch-off motion, the latching is released. Thereafter, the stop slide 22 is movable from its initial latched position in both directions. The toggle joint 13 faces in a direction away from the stop slide 22 and being acted upon by a reset spring 24.

Figure 11:
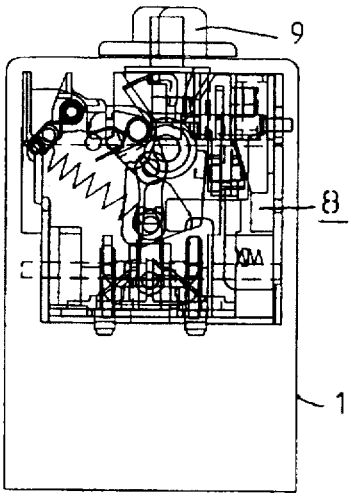
Figure 12:
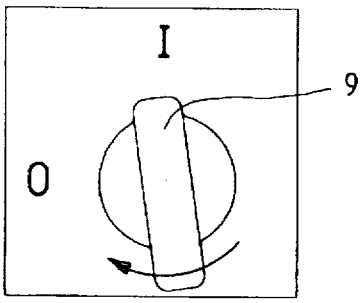
Figure 13:
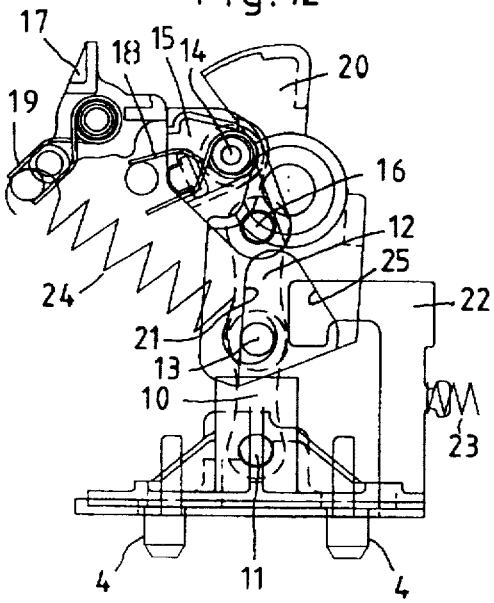

FIGS. 8–13 show the overcurrent protective switch in two intermediate positions during a switching on motion. The control knob 9 is rotated clockwise manually. In the first intermediate position depicted in FIGS. 8–10, the hand-operated lever 20 rotates counterclockwise until the driving surface 21 is engaged with the toggle joint 13. The pawl lever 15 is braced by the trigger pawl 17, and is thereby obstructed from any further counterclockwise motion. The joint axle 16 on the pawl lever 15 remains motionless relative to the housing 1. From this moment, the driving surface 21 drags the toggle joint 13 along in the counterclockwise direction. By further rotation of the control knob 9, the limiting condition depicted in FIGS. 11–13 is achieved, at which the switch splicing plate 10 and the toggle lever splicing plate 12 are aligned behind each other in one line, and the overcurrent protective switch is turned on. The toggle joint 13 is then engaged with the stop slide 22. By further rotation of the control knob 9, the toggle joint 13 jumps into a position past dead center condition, thereby supporting itself through the already latched stop slide 22. Thus, the turning on of the overcurrent protective switch shown in FIGS. 14–16 is achieved.

Figure 22:
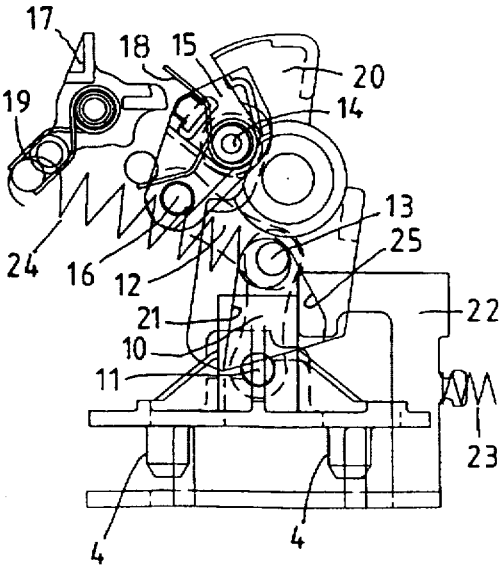
Figure 23:
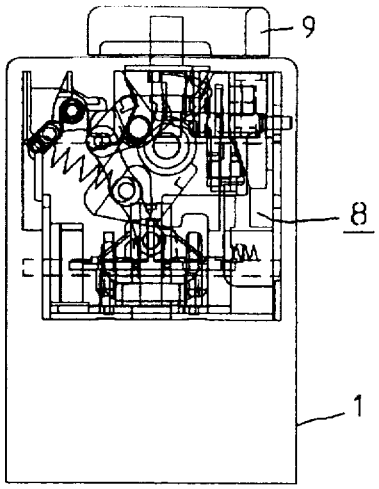
Figure 26:
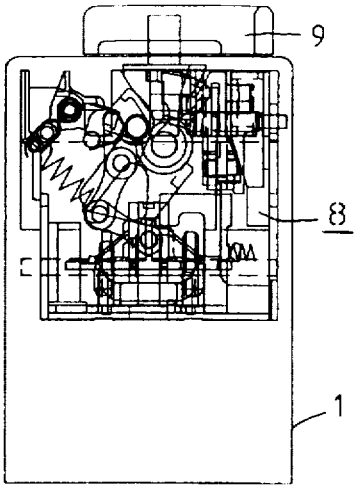
Figure 24:
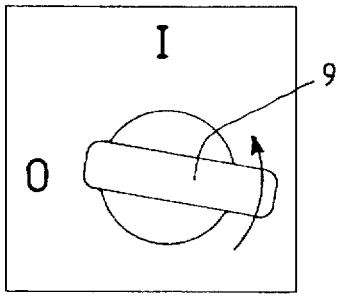
Figure 27:
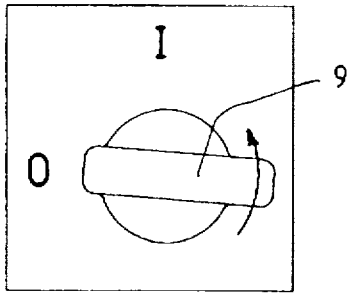
Figure 25:
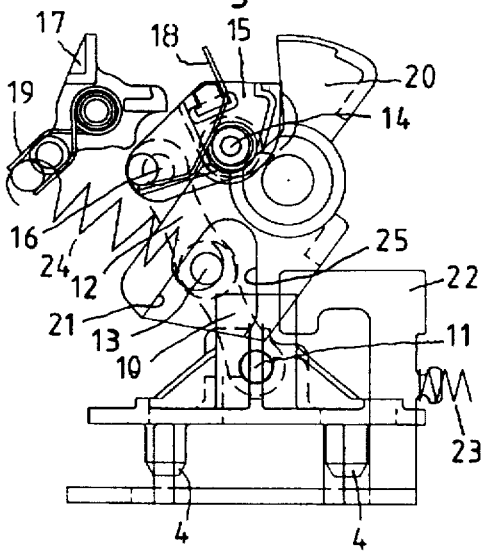
Figure 28:
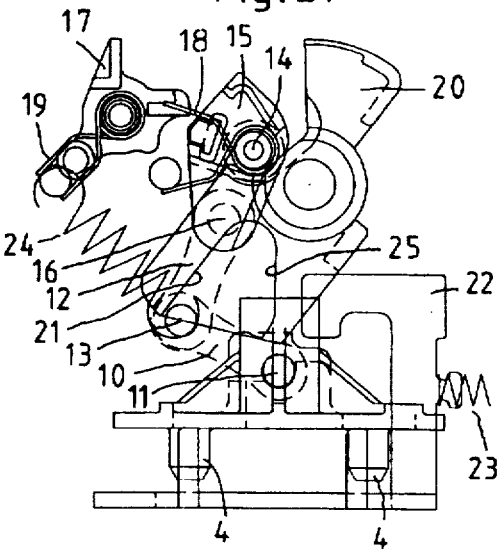

FIGS. 17–28 show the overcurrent protective switch in four different intermediate positions during a switching off motion. The switching off motion is initiated when the control knob 9 is rotated counterclockwise. Thereafter, the latch release of the stop slide 22, specifically depicted in FIG. 19, follows the hand-operated device. By the force of the switch-off spring exerted through the toggle joint 13, the stop slide 22 is displaced in FIG. 10 to the right. As soon as the joint axle 16 between the toggle lever splicing plate 12 and the toggle lever 15 is out of the dead center position shown in FIG. 19, the arrangement is bent as shown in FIG. 22, thereby contact separation follows abruptly. When rotating the control knob 9 further FIG. 25, the reset spring 24 pulls the toggle joint 13 further and causes the toggle lever pair to bend in FIG. 28, and the switch-off state is achieved.

The two-armed hand-operated lever 20 exhibits a two-pronged switch fork on the arm facing away from the bevel gear with two facing inner surfaces. One of the surfaces is the driving surface 21, illustrated in FIGS. 8–13. The facing surface 25 is effective when, for any reason, the stop bar 22 is blocked at the switching off motion. When this occurs, the toggle lever pair 10, 12 cannot be bent in, and thus, the switching off motion cannot be completed. However, when rotating the control knob 9 further, the surface 25 guides the toggle joint 13 along in a direction facing away from the stop slide 22. After having gone beyond the dead center position, the toggle lever pair 10,12 bends in, thereby causing a quick contact separation to occur.

FIGS. 29–34 show the overcurrent protective switch after an actuation through the overcurrent triggering elements has occurred. FIGS. 29–31 depict the after-actuation status with a retained control knob 9, whereas FIGS. 32–34 depict the same situation with a freely moving control knob 9. When responding to the overcurrent triggering elements, the trigger pawl 17 rotates counterclockwise away from the pawl lever 15. When the overcurrent protective switch is turned on FIGS. 14–16, the power level 15 is no longer braced by the trigger panel 17 in the counterclockwise direction. Therefore, independent of whether the control knob 9 is fixed or free, after the trigger pawl 17 has swiveled away, the pawl lever 15 is set free and swivels in the counterclockwise direction. In this manner, the joint axle 16 of the toggle lever splicing plate 12 on the pawl lever, and along with it also the switch lever 5, will snap upward, and in accordance, the fixed and movable contact pieces 2, 3 will abruptly separate. In the case when the control knob 9 is fixed, the contact separation will nevertheless occur, similar to the case of a free control knob 9, with the only difference that the knob will remain in the on position. As soon as the control knob is released or is not fixed, it swivels to the position shown in FIG. 33, and thus, enables the visual determination of a current surge.

The pawl lever 15, depending on whether triggered manually or by overcurrent, acts differently in the two directions. Therefore, it can be utilized to actuate a signal switch which will then indicate the actuation of the overcurrent protective switch by overcurrent triggering agents.

The instant invention has been shown and described herein in what is considered to be the most practical and preferred embodiment. It is recognized, however, that departures may be made therefrom within the scope of the invention and that obvious modifications will occur to a person skilled in the art.

We claim:

1. An overcurrent protective switch comprising:

a housing;

a hand operated triggering device;

an overcurrent triggering element;

fixed contact pieces coupled to the housing;

moveable contact pieces arranged to bypass the fixed contact pieces when the overcurrent protective switch is in an on-position;

a switch lock coupled to the moveable contact pieces, the switch lock comprising a switch splicing plate having a first joint axle, and a toggle lever splicing plate having a second joint axle, the toggle lever splicing plate coupled to the switch splicing plate through a third joint axle defining a toggle joint;

a switch-off spring coupled to the toggle joint and the housing;

a reset spring coupled to the toggle joint and the housing;

a releasable latching stop slide coupled to the hand operated triggering device and released when the hand operated device is moved from the on-position to an off-position, the hand operated device coupled to at least one driving surface which drives the toggle joint when the hand operated device is switched to the on position;

a trigger pawl coupled to the overcurrent triggering element; and a pawl lever rotatably mounted on a pivot bearing axle coupled to the housing, the pawl lever further coupled in swivel arrangement with the second joint axle, the pawl lever swinging about the bearing axle in a first direction when the trigger pawl is actuated and a second direction when the stop slide is released.

2. The overcurrent protective switch as set forth in claim 1, wherein the pawl lever comprises two arms and a torsion spring which holds the pawl lever spaced apart from the trigger pawl while the pawl lever is at a neutral position corresponding to the off-position of the overcurrent protective switch.

3. The overcurrent protective switch as set forth in claim 2 wherein the trigger pawl includes a second torsion spring which holds the trigger pawl in the neutral position, blocking the pawl lever.

4. The overcurrent protective switch as set forth in claim 1, wherein the hand operated device is coupled to a two-pronged pivoting switch fork comprising two facing inner surfaces positioned to engage the toggle joint when moving the hand-operated device between the on-position and the off-position.

* * * * *